US007905590B2

(12) United States Patent
Yorimoto

(10) Patent No.: US 7,905,590 B2
(45) Date of Patent: Mar. 15, 2011

(54) IMAGE FORMING METHOD AND APPARATUS CAPABLE FOR PREVENTING COCKLING

(75) Inventor: Mamoru Yorimoto, Tama (JP)

(73) Assignee: Ricoh Company, Ltd., Tokyo (JP)

( * ) Notice: Subject to any disclaimer, the term of this patent is extended or adjusted under 35 U.S.C. 154(b) by 567 days.

(21) Appl. No.: 11/945,643

(22) Filed: Nov. 27, 2007

(65) Prior Publication Data

US 2008/0122890 A1 May 29, 2008

(30) Foreign Application Priority Data

Nov. 27, 2006 (JP) ..... 2006-318285

(51) Int. Cl.
*B41J 2/01* (2006.01)

(52) U.S. Cl. ..... 347/104; 347/8; 347/16

(58) Field of Classification Search ..... 347/8, 102, 347/104, 5, 9, 16, 19
See application file for complete search history.

(56) References Cited

U.S. PATENT DOCUMENTS

| | | | | |
|---|---|---|---|---|
| 2002/0027588 | A1* | 3/2002 | Kiyama | 347/104 |
| 2004/0188922 | A1 | 9/2004 | Takahashi et al. | |
| 2006/0180988 | A1 | 8/2006 | Yorimoto et al. | |
| 2007/0108696 | A1 | 5/2007 | Yorimoto | |

FOREIGN PATENT DOCUMENTS

| | | | |
|---|---|---|---|
| JP | 404065265 | * | 3/1992 |
| JP | 11-348373 | | 12/1999 |
| JP | 2000-62150 | | 2/2000 |
| JP | 2001-287427 | | 10/2001 |
| JP | 2005-29333 | | 2/2005 |
| JP | 2005-343636 | | 12/2005 |

* cited by examiner

*Primary Examiner* — Lam S Nguyen
(74) *Attorney, Agent, or Firm* — Cooper & Dunham LLP

(57) ABSTRACT

A liquid-ejection-type image forming apparatus includes a recording head configured to print by ejecting ink liquid, and an electrostatic-absorption belt configured to convey printing paper. The liquid-ejection-type image forming apparatus performs a cockling-preventing mode operation which stops printing operation, separates the printing paper from the electrostatic-absorption belt, and restarts the printing operation after replacing the printing paper on the electrostatic-absorption belt.

18 Claims, 9 Drawing Sheets

IMAGE FORMING METHOD AND APPARATUS CAPABLE FOR PREVENTING COCKLING

TECHNICAL FIELD

The present disclosure relates to an image forming apparatus, and more particularly to an image forming apparatus capable for preventing cockling.

BACKGROUND ART

Recently, an image forming apparatus that employs liquid ejection method is available as a printer, a facsimile machine, a copier, a plotter, or a multi-functional apparatus having multiple functions thereof. Such image forming apparatus may include a recording head and an electrostatic-absorption belt. The recording head dispenses ink onto a recording sheet to form an image on the recording sheet. The electrostatic-absorption belt conveys the recording sheet.

Such sheet may include a medium made of material such as paper, string, fiber, cloth, leather, metal, plastic, glass, timber, and ceramic, for example. Further, "image formation" used herein refers to providing, recording, printing, or imaging an image, a letter, a figure, and a pattern to a sheet. Moreover, "liquid" used herein is not limited to recording liquid or ink, but may include anything discharged in the form of fluid. Hereinafter, the recording liquid may be referred to as ink for the simplicity of description.

In such image forming apparatus, when the ink are ejected onto a recording sheet, so called "cockling" may occur. Cockling of the recording sheet tends to cause the recording sheet to bend in an uncontrolled manner downward away from the recording head and upward toward the recording head. It is important to avoid an occurrence of cockling to maintain an image quality by preventing a carriage from contacting the recording sheet.

An image forming apparatus employs a mechanism to adjust a distance between a carriage and a recording sheet to have a space therebetween. However, if a cockling phenomenon occurs, it is difficult to recover a positioning error of the ink dispensed onto the recording sheet. Consequently, a quality of an image decreases.

BRIEF SUMMARY

In an aspect of this disclosure, there is provided a novel liquid-ejection-type image forming apparatus that includes a recording head configured to print by ejecting ink liquid, and an electrostatic-absorption belt configured to convey printing paper. The liquid-ejection-type image forming apparatus performs a cockling-preventing mode operation which stops printing operation, separates the printing paper from the electrostatic-absorption belt, and restarts the printing operation after placing the printing paper again on the electrostatic-absorption belt.

In another aspect, there is provided a novel method for preventing cockling at liquid-ejection-type image forming apparatus, including steps of conveying printing paper, printing by ejecting liquid droplets, performing a cockling-preventing mode operation which stops printing operation, separating the printing paper from an electrostatic-absorption belt, and restarting the printing operation after placing the printing paper again on the electrostatic-absorption belt.

BRIEF DESCRIPTION OF THE DRAWINGS

A more complete appreciation of the aforementioned and other aspects, features and advantages will be readily obtained as the same becomes better understood by reference to the following detailed description when considered in connection with the accompanying drawings, wherein.

DETAILED DESCRIPTION OF PREFERRED EMBODIMENTS

Figure 1:
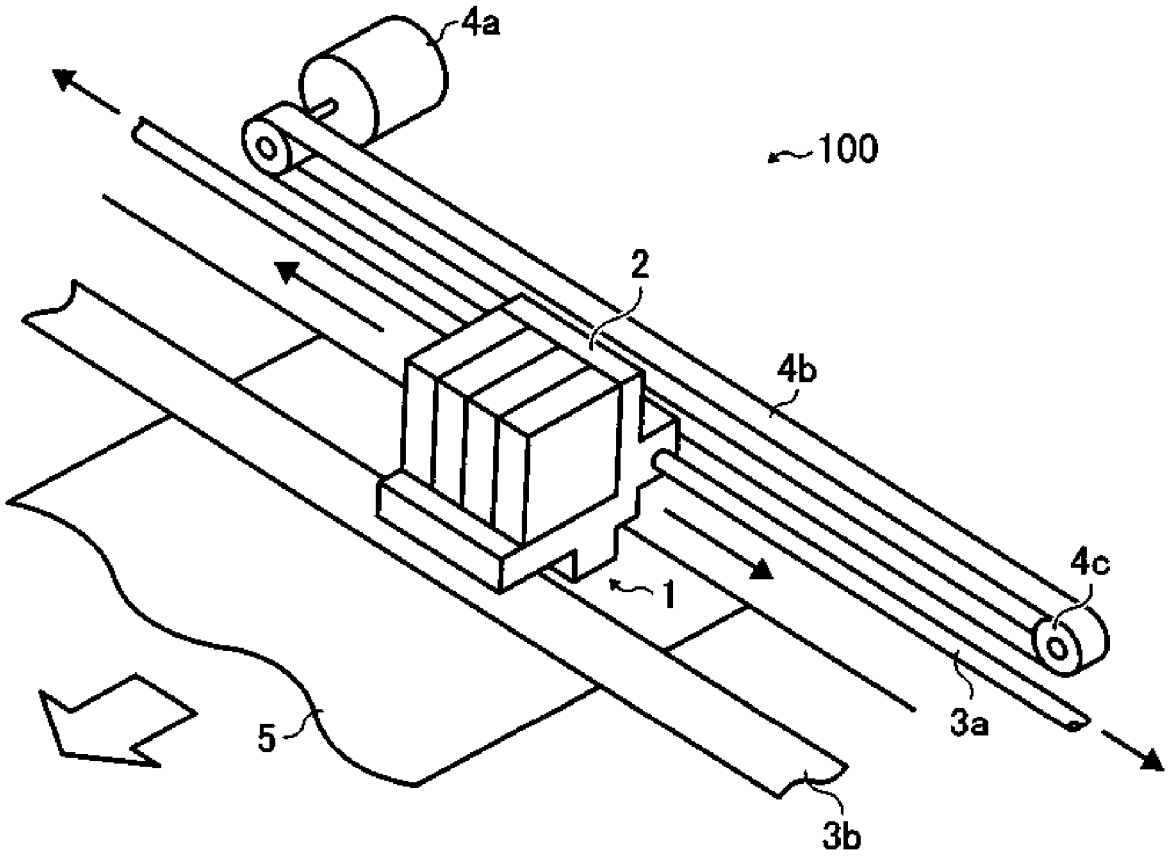
FIG. 1 illustrates a schematic diagram of substantial parts of a liquid-ejection-type image forming apparatus.

In describing preferred embodiments illustrated in the drawings, specific terminology is employed for the sake of clarity. However, the disclosure of this patent specification is not intended to be limited to the specific terminology so selected, and it is to be understood that each specific element includes all technical equivalents that operate in a similar manner.

Referring now to the drawings, wherein like reference numerals designate identical or corresponding parts throughout the several views, particularly to FIG. 1, an image forming apparatus according to exemplary embodiments is described.

FIG. 1 is a schematic diagram of substantial parts 100 of a liquid-ejection-type image forming apparatus such as an ink-jet printer, etc. The image forming apparatus includes a recording head 1 configured to print an image, a carriage 2 having the recording head 1, guide mechanisms 3 (a guide shaft 3*a* and a guide plate 3*b*) configured to move the carriage 2 in a main scanning direction, and driving force transmission mechanisms 4 (a drive motor 4*a*, a timing belt 4*b* and pulley 4*c*). The recording head 1 dispenses ink onto a recording sheet 5 (hereinafter referred to as "sheet") to form an image on the sheet 5.

Figure 2:
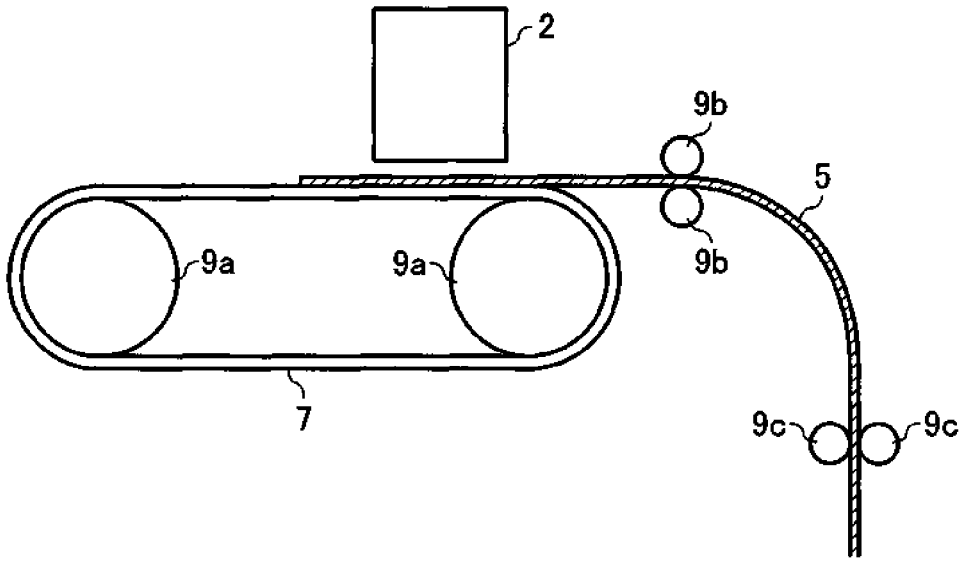
FIG. 2 illustrates a schematic side view of an electrostatic-absorption belt provided in the apparatus of FIG. 1.

FIG. 2 is a schematic side view of an electrostatic-absorption belt 7 provided in the apparatus of FIG. 1. The electrostatic-absorption belt 7 rotates in a counter-clockwise direction while the image is printed on the sheet 5, and conveys the sheet 5 to a downstream side relative to the rotation direction. However, cockling may occur depending on a printing condition of the sheet 5. If the sheet 5 is shaped into a waveform due to occurrence of cockling, the carriage 2 or a bottom surface of the recording head 1 may contact a surface of the sheet 5 and an image defect may be occurred. Reference numerals 9*a*, 9*b*, and 9*c* denote belt conveyance rollers, a pair of resist rollers, and a pair of conveyance rollers, respectively.

Figure 3:
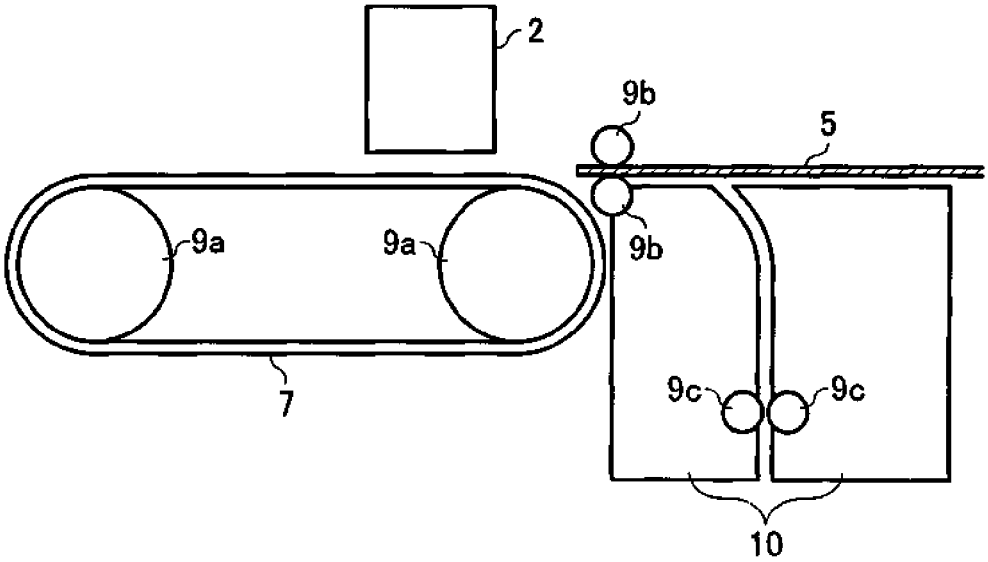
FIG. 3 illustrates a schematic side view of the electrostatic-absorption belt according to a first embodiment of the present invention.

FIG. 3 is a schematic side view of the electrostatic-absorption belt 7 according to a first embodiment of the present invention. When a cockling-preventing mode is set, a printing operation is temporarily stopped, the electrostatic-absorption belt 7 is rotated in a clockwise direction, and the sheet 5 is removed from an absorption surface of the electrostatic-absorption belt 7. At this time, the sheet 5 is conveyed to an evacuation guide plate 10 positioned at an upstream side of the electrostatic-absorption belt 7 relative to the rotation direction. Then, the sheet 5 is conveyed onto the electrostatic-absorption belt 7 again and reabsorbed. The printing operation is restarted, the electrostatic-absorption belt 7 is rotated in the counter-clockwise direction, and the sheet 5 is conveyed to the downstream side relative to the rotation direction. With such operations, the electrostatic-absorption belt 7 re-adheres the sheet 5 to suppress waving of the sheet 5, thus avoiding defective images.

Specifically, when the cockling-preventing mode is set, the printing operation to print an image to the sheet 5 on the electrostatic-absorption belt 7 is temporarily stopped, and the sheet 5 is temporarily removed from the belt absorption surface of the electrostatic-absorption belt 7, and is reabsorbed onto the electrostatic-absorption belt 7. Therefore, the sheet 5 is stretched so as to prevent the sheet 5 from contacting the surface of the carriage 2. As a result, the image defect is prevented. Also, defective imaging caused by fluctuation in a distance between the recording head 1 and the sheet 5 during the printing operation is avoided.

A grip roller (a pair of resist rollers 9*b* and 9*b*) conveys the sheet 5 when the sheet 5 is to be removed for reabsorption of the belt 7. The resist rollers 9*b* and 9*b* press against the sheet 5 to flatten the sheet 5 while the sheet 5 is removed. The image adheres to the rollers 9*b* and 9*b* if the rollers 9*b* and 9*b* contact the sheet 5 before the image is dried. In such a case, a time for drying the image is secured. As a result, the image defect, which is caused by contact of the sheet 5 with the surface of the carriage 2, is avoided.

In the example shown in FIGS. 2 and 3, the resist rollers 9*b* and 9*b*, that are provided on the upstream side of the electrostatic-absorption belt 7 relative to the rotation direction, also function as the grip roller for evacuating the sheet 5. Therefore, an additional grip roller is not required, which results in simplification of the configuration. As a result, cost reduction and space saving can be achieved. In addition, an effect to flatten the sheet 5 can be large because of high pressing force.

Figure 4:
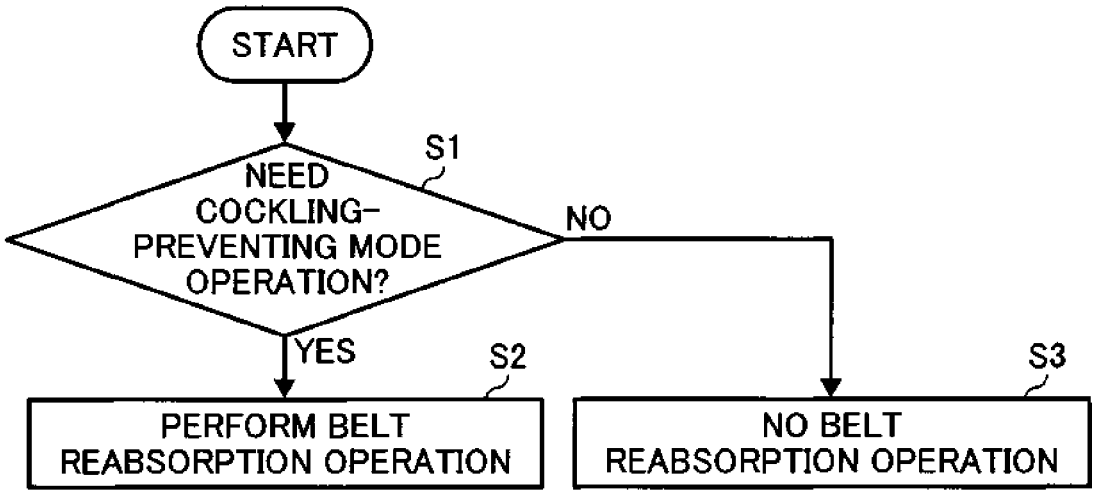
FIGS. 4, 5, 6, 7, 8, 9, and 10 are flow charts illustrating control specifications of the liquid-ejection-type image forming apparatus according to a second, third, fourth, fifth, sixth, and seventh embodiments, respectively.

FIG. 4 is a flowchart showing a control specification of the liquid-ejection-type image forming apparatus according to the first embodiment. The cockling-preventing mode, which can be set in the apparatus shown in FIG. 3, includes following operations. If the cockling-preventing mode is set in step S1 (step S1: Yes), the printing operation to print an image to the sheet 5 on the electrostatic-absorption belt 7 is temporarily stopped, the sheet 5 is temporarily removed, from the belt absorption surface of the electrostatic-absorption belt 7, and then, the sheet 5 is reabsorbed on the electrostatic-absorption belt 7 again (step S2). Accordingly, waving of the sheet 5 caused by a cockling phenomenon is flattened, and the sheet 5 is prevented from contacting the carriage 2 or the surface of the recording head 1. As a result, an image defect can be prevented. If the cockling-preventing mode is not set in step S1 (step S1: No), a reabsorbing operation of the electrostatic-absorption belt 7 is not required (step S3). Therefore, productivity, which may be reduced due to a time spent for reabsorption, is not decreased.

Second Embodiment

Figure 5:
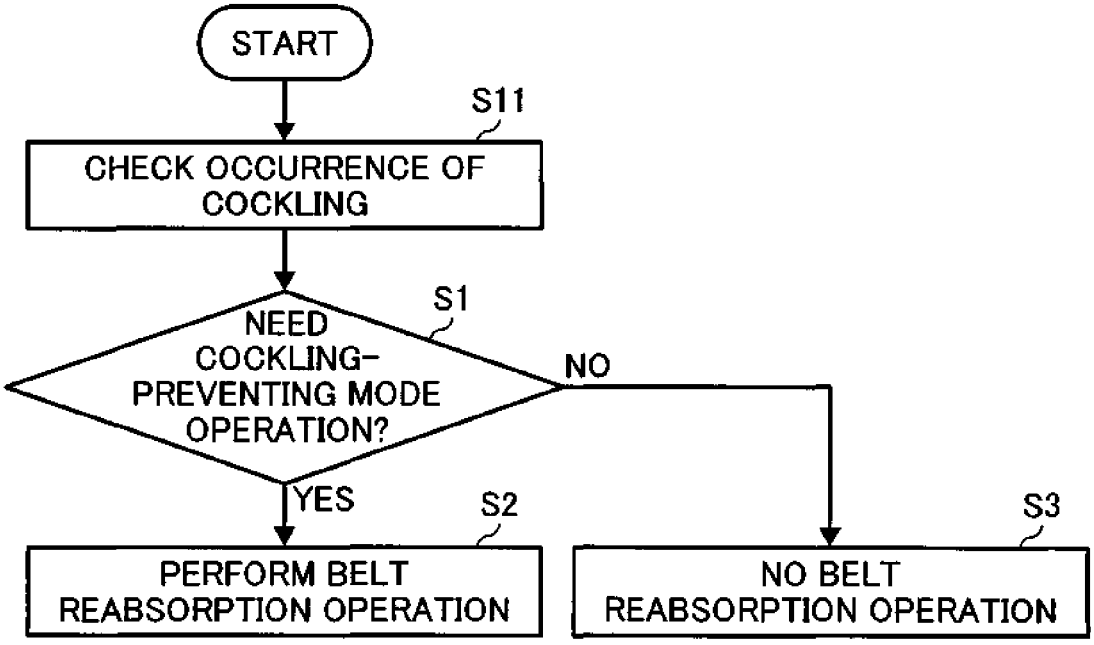

FIG. 5 is a flowchart of a control specification of the liquid-ejection-type image forming apparatus according to a second embodiment. In this embodiment, the apparatus includes a detector to check occurrence of cockling (the detector may be any kind of hardware or software)(step S11). When the detector detects occurrence of cockling, the cockling-preventing mode is automatically set (step S1: Yes). Accordingly, a user is not required to input information regarding occurrence of cockling from an operation panel, or the like to set the cockling-preventing mode. Therefore, user operability is improved, and an image defect, which may be caused by setting failure, can be avoided. When the detector does not detect occurrence of cockling, the cockling-preventing mode is not set (step S1: No), and the reabsorption of the electrostatic-absorption belt 7 is not required, (step S3).

Namely, occurrence of cockling is not determined based on print setting information, which is transferred, or set in the machine. Therefore, a user is not required to set the cockling-preventing mode by inputting information from the operational panel, etc. Thus, the user operability can be improved, and the image defect while conveying the sheet 5 can be avoided without any mode being set.

Third Embodiment

Figure 6:
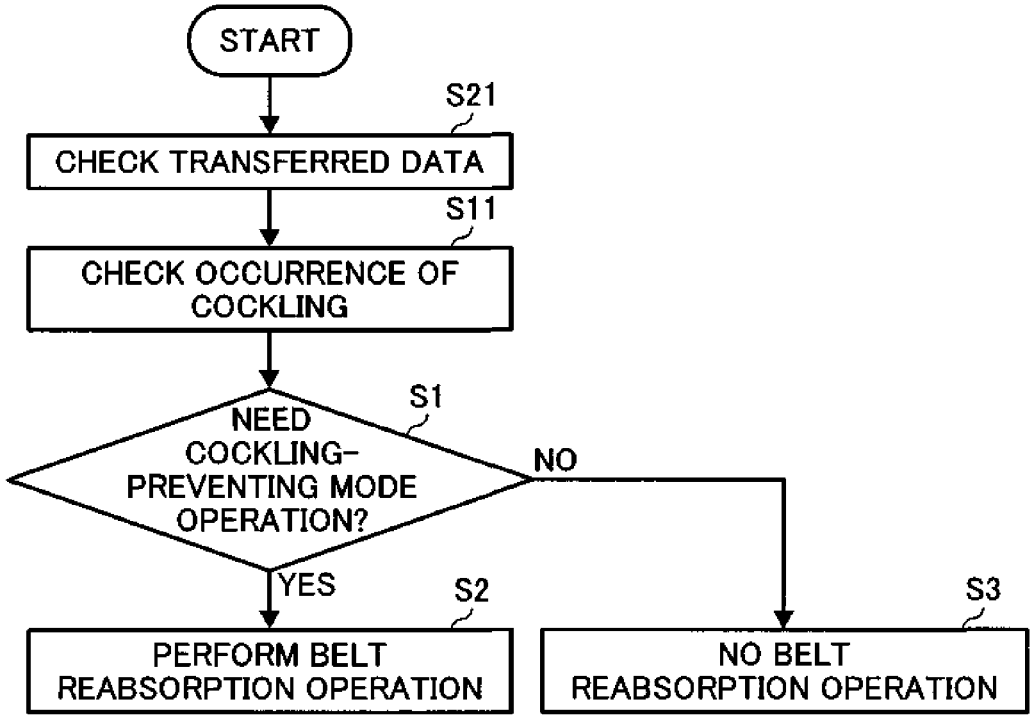

FIG. 6 is a flowchart showing a control specification of the liquid-ejection-type image forming apparatus according to a third embodiment. Occurrence of cockling is automatically determined based on information set in the machine, and/or transferred print setting data (step S21, S11, S1, and S2. The cockling-preventing mode is easily set by acquiring information, which is required to be input by a user when the user prints out an image, to determine occurrence of cockling. If the cockling-preventing mode is not set (step S1: No), the reabsorption of the electrostatic-absorption belt 7 is not required. Therefore, the reabsorption is not performed (step S3).

Fourth Embodiment

Figure 7:
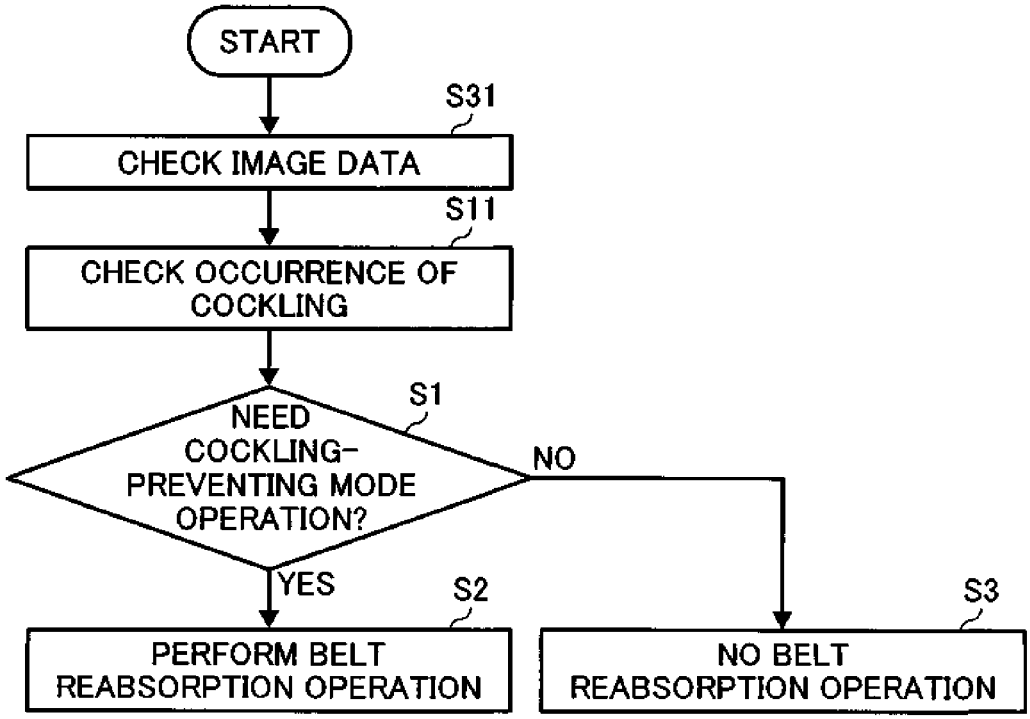

FIG. 7 is a flowchart showing a control specification of the liquid-ejection-type image forming apparatus according to a fourth embodiment. Occurrence of cockling is automatically determined based on image data to be printed out (steps S31, S11, S1, and S2). For example, occurrence of cockling is determined based on an ink discharge amount assumed from the image data, or superimposition possibility in a case that a high quality image mode is set. The cockling-preventing mode is automatically set based on the determination result. In the fourth embodiment, similar to the other embodiments, the reabsorption of the electrostatic-absorption belt 7 is not required when the cockling-preventing mode is not set (step S1: No). Therefore, the reabsorption is not performed (step S3).

Fifth Embodiment

Figure 8:
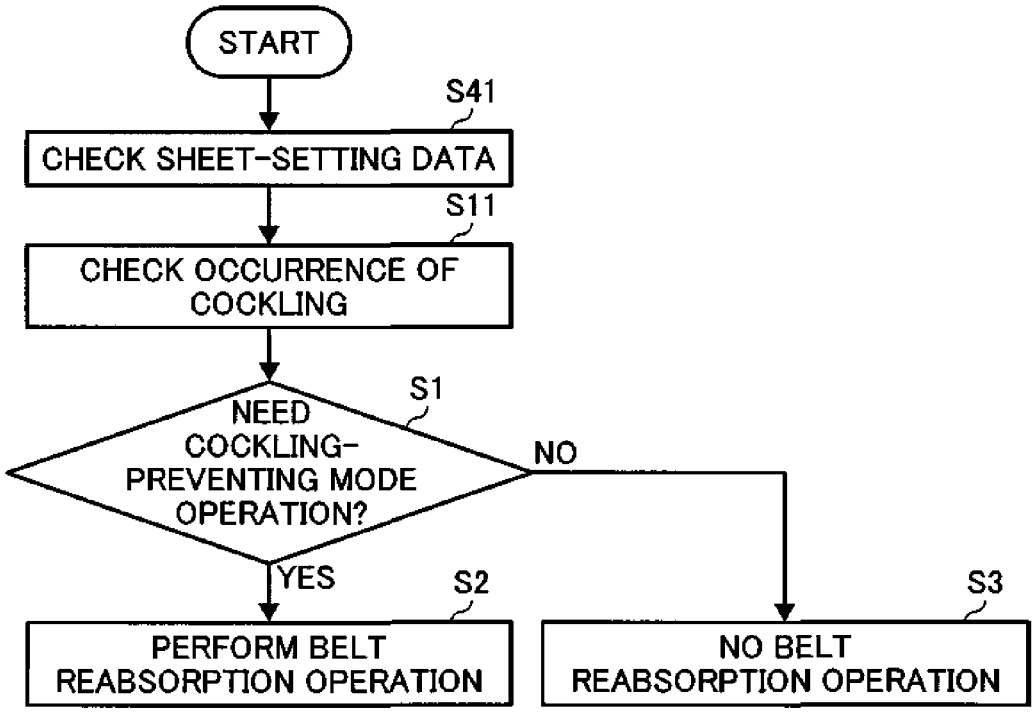

FIG. 8 is a flowchart showing a control specification of the liquid-ejection-type image forming apparatus according to a fifth embodiment. In this embodiment, occurrence of cockling is determined based on sheet setting data such as a type, thickness and a size of the sheet. The cockling-preventing mode is set based on the determination result (step S41, S11, S1, and S2). Accordingly, the cockling-preventing mode is automatically set by determining occurrence of cockling based on ink permeability assumed from the sheet setting data. When the cockling-preventing mode is not set (step S1: No), the reabsorption of the electrostatic-absorption belt 7 is not required. Accordingly, the reabsorption is not performed (step S3).

Sixth Embodiment

Figure 9:
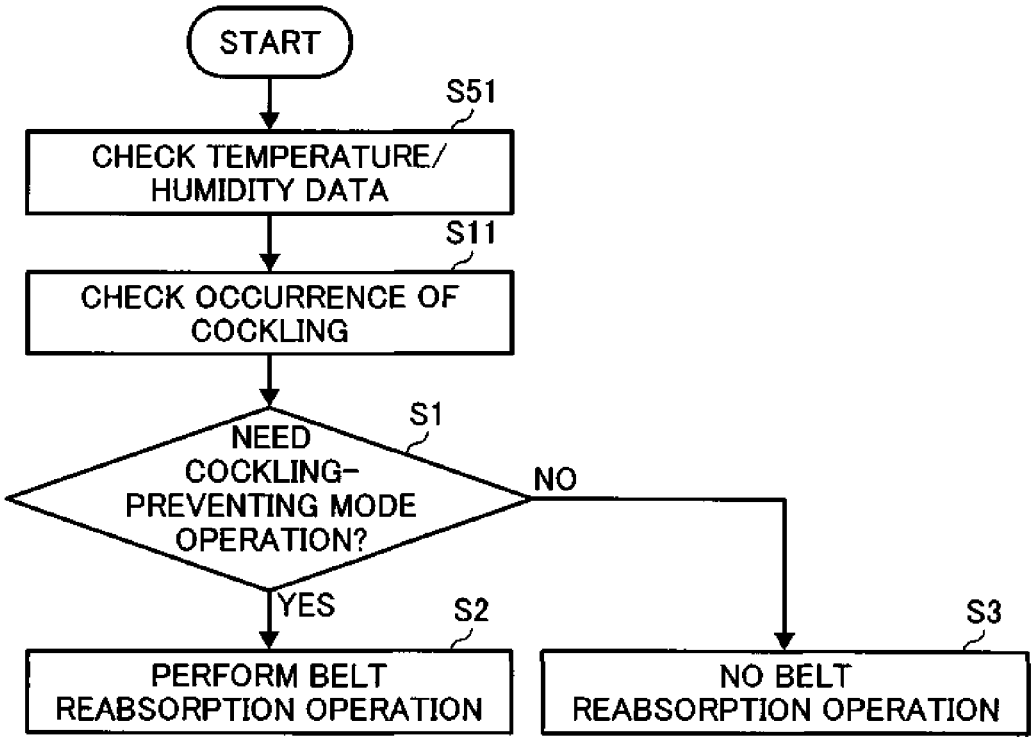

FIG. 9 is a flowchart showing a control specification of the liquid-ejection-type image forming apparatus according to a sixth embodiment. In this embodiment, occurrence of cockling is automatically determined based on temperature and humidity data in which effects of temperature and humidity environments and ink permeability are considered (step S51, S11, S1, and S2). The cockling-preventing mode is automatically set based on the determination result. When the cockling-preventing mode is not set (step S1: No), the reabsorption of the electrostatic-absorption belt 7 is not required. Accordingly, the reabsorption is not performed (step S3).

Seventh Embodiment

Figure 10:
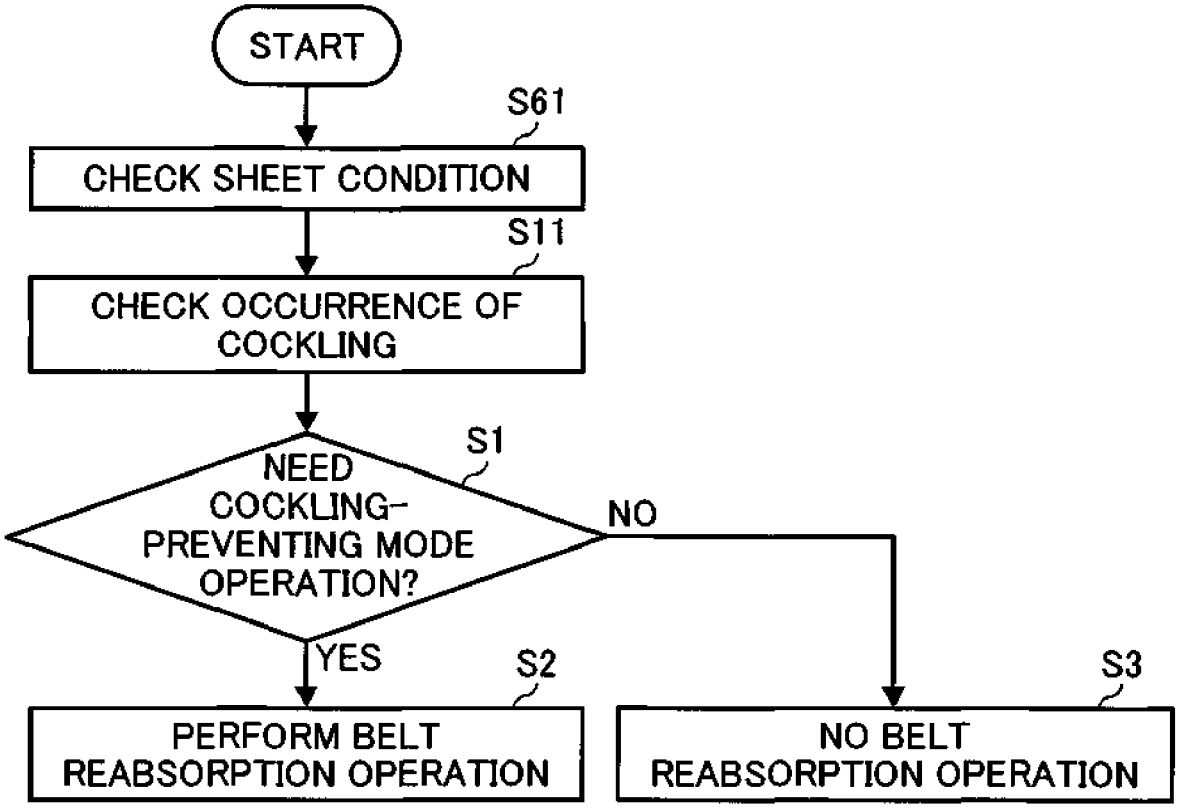

FIG. 10 is a flowchart showing a control specification of the liquid-ejection-type image forming apparatus according to a seventh embodiment. In this embodiment, a monitor to check a condition of the sheet 5 is provided, and occurrence of cockling is automatically determined based on a monitoring result (step S61, S11, S1, and S2). Accordingly, occurrence of cockling is determined in a reliable manner, and the cockling-preventing mode is automatically set. In step S61 shown in FIG. 10, a monitor including hardware such as a sensor, etc. and software to determine occurrence of cockling from detected data checks sheet conditions. When the cockling-preventing mode is not set (step S1: No), the reabsorption of the electrostatic-absorption belt 7 is not required. Accordingly, the reabsorption is not performed (step S3).

Figure 11:
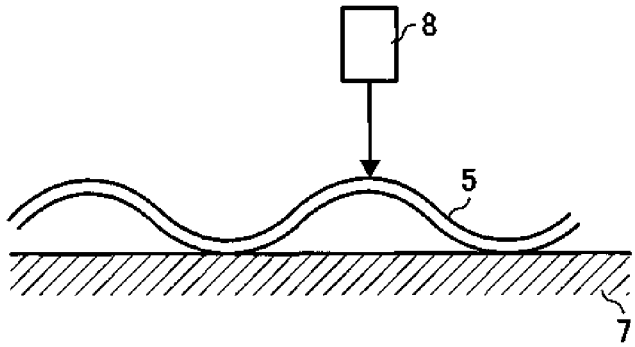
FIG. 11 illustrates a cross-sectional view of a reflection type photo sensor functioning as a monitor according to the seventh embodiment.

FIG. 11 is a cross-sectional view showing an example of the monitor. A reflective type photosensor 8 for monitoring the sheet 5 from perpendicular direction relative to a conveyance direction of the sheet 5 is provided. The photo sensor 8 monitors a distance between the photosensor 8 and the sheet 5. Namely, the waved surface of the sheet 5 caused by cockling is checked, based on the distance between the sheet 5 and the photosensor 8. Accordingly, occurrence of cockling is reliably determined, and the cockling-preventing mode is automatically set. More specifically, the waved surface of the sheet 5 caused by cockling is checked by the reflective type photosensor, which monitors a distance between the sheet and the reflective type photosensor from the perpendicular direction of the sheet. Accordingly, occurrence of cockling is reliably determined, and the cockling-preventing mode can be automatically set.

Eighth Embodiment

Figure 12:
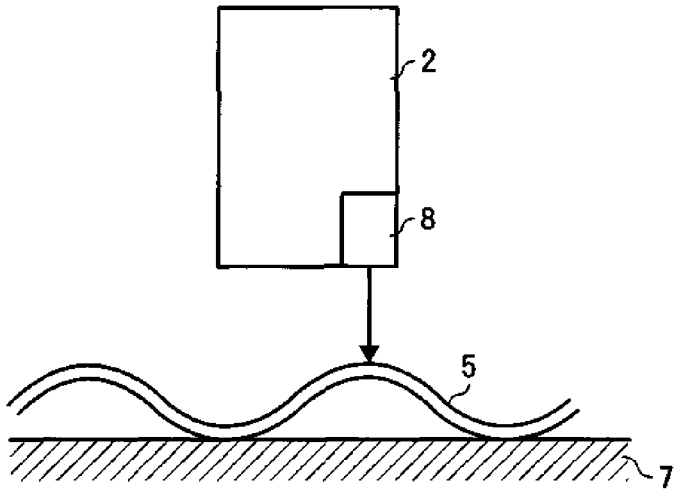
FIGS. 12, 13, and 14 illustrate schematic diagrams of substantial parts of the liquid-ejection-type image forming apparatus according to an eighth, ninth, and tenth embodiments, respectively.

FIG. 12 is a schematic cross-sectional view showing a part of the liquid-ejection-type image forming apparatus according to an eighth embodiment. In this embodiment, the reflective type photosensor 8 is provided in the carriage 2. Therefore, the photosensor 8 can monitor the entire sheet 5 along with the movement of the carriage 2. Since the carriage 2 requires to provide one sensor and integration of the sensor into the carriage 2 is possible, cost reduction and a simple configuration of the image forming apparatus can be achieved.

Ninth Embodiment

Figure 13:
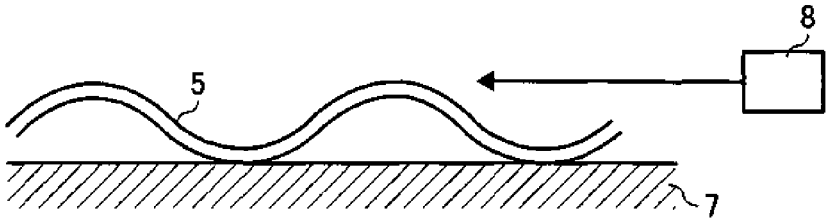

FIG. 13 is a schematic diagram of a part of the liquid-ejection-type image forming apparatus according to a ninth embodiment. In this embodiment, the reflective type photosensor 8 functioning as a monitor to detect occurrence of cockling is provided in a horizontal direction relative to the conveyance direction of the sheet 5. The photosensor 8 monitors height of an embossed part of the waved surface of the sheet 5. Accordingly, occurrence of cockling is reliably determined, and the cockling-preventing mode is automatically set. If the sensor has a wide viewing angle, the monitoring from the horizontal direction can monitor wider area with one sensor, in comparison to the monitoring from the perpendicular direction. As a result, monitoring efficiency can be increased.

Tenth Embodiment

Figure 14:
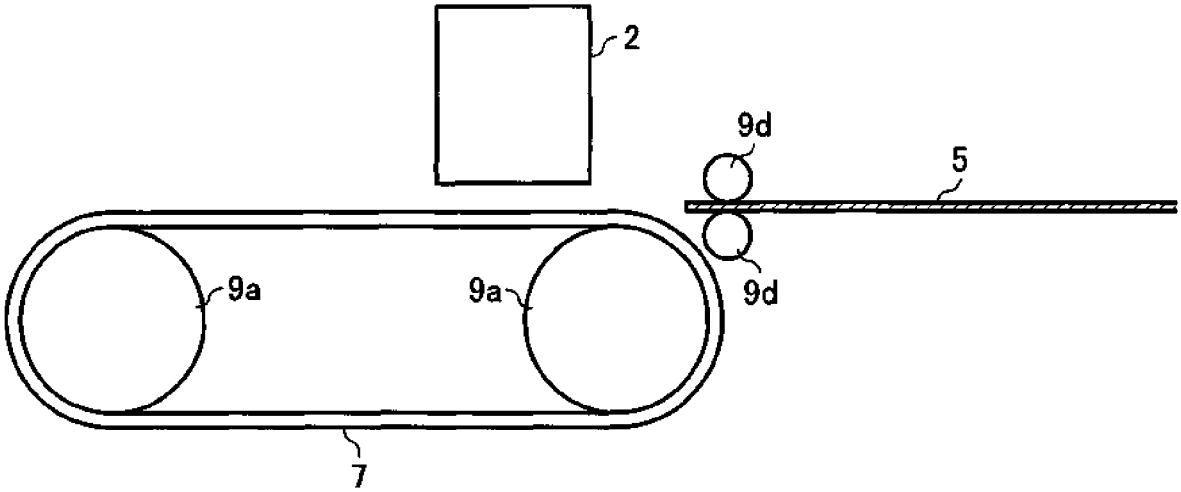

FIG. 14 is a schematic diagram of a part of the liquid-ejection-type image forming apparatus according to a tenth embodiment. In this embodiment, a pair of gears 9*d* and 9*d* is provided as rollers for evacuating the sheet 5, thereby preventing the rollers from adhering the image. In addition, since there is no need to dry the image, productivity can be increased.

Eleventh Embodiment

Figure 15:
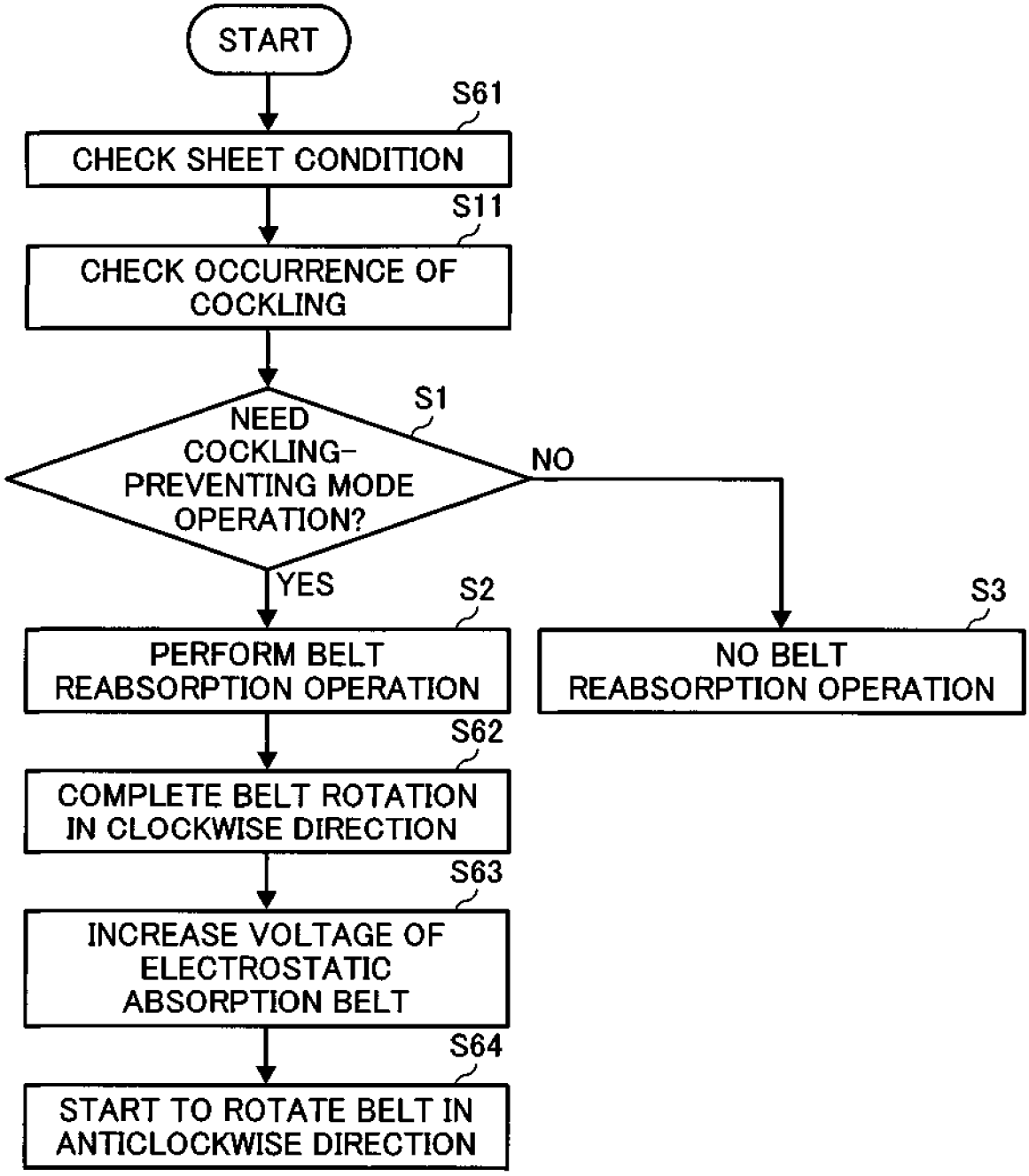
FIG. 15 is a flowchart illustrating a control specification of the liquid-ejection-type image forming apparatus according to an eleventh embodiment.

FIG. 15 is a flowchart showing a control specification of the liquid-ejection-type image forming apparatus according to an eleventh embodiment. In this embodiment, if the cockling-preventing mode is set (step S61, S11, S1, S2, and S62), voltage applied to the electrostatic-absorption belt 7 is increased when the temporarily removed sheet 5 is reabsorbed to the electrostatic-absorption belt 7 (step S63). Accordingly, the belt 7 increases force to poll the sheet 5 towards the belt 7 while being rotated, (step S64). As a result, the waved surface of the sheet 5 is flattened.

Embodiments in which the reflective type photo sensor is used, have been explained. However, the sensor as hardware is not limited to the reflective type photosensor.

Numerous additional modifications and variations are possible in light of the above teachings. It is therefore to be understood that, within the scope of the appended claims, the disclosure of this patent specification may be practiced otherwise than as specifically described herein.

This patent specification is based on Japanese Patent Application, No. 2006-318235 filed on Nov. 27, 2006 in the Japanese Patent Office, the entire contents of which are incorporated by reference herein.

What is claimed is:

1. A liquid-ejection-type image forming apparatus, comprising:

a recording head configured to print by ejecting liquid droplets;

an electrostatic-absorption belt configured to convey printing paper in a sheet conveyance direction for the recording head to eject the liquid droplets onto the conveyed printing paper;

an evacuation guide plate positioned upstream of the recording head in the sheet conveyance direction; and a pair of grip rollers configured to evacuate the printing paper temporally from an absorption surface of the electrostatic-absorption belt, the pair of grip rollers being disposed at an end of the evacuation guide plate, wherein the liquid-ejection-type image forming apparatus performs a cockling-preventing mode operation which stops printing operation, separates the printing paper from the electrostatic-absorption belt, and restarts the printing operation after the evacuated printing paper is placed again on and absorbed by the electrostatic-absorption belt, and wherein when the printing operation stops in the cockling-preventing mode operation, the electrostatic-absorption belt conveys the printing paper in an evacuation direction, opposite to the sheet conveyance direction, to the pair of grip rollers, the pair of grip rollers evacuate the printing paper temporally from the absorption surface of the electrostatic-absorption belt and conveys the printing sheet in the evacuation direction onto the evacuation guide plate, and then the grip rollers convey the printing paper on the evacuation guide plate in the sheet conveyance direction to place the printing sheet again onto the electrostatic-absorption belt, and the printing operation is restarted after the printing paper is again on and absorbed by the electrostatic-absorption belt.

2. The image forming apparatus of claim 1, further comprising:

a detector configured to detect an occurrence of cockling and to set the liquid-ejection-type image forming apparatus in the cockling-preventing mode to cause the liquid-ejection-type image forming apparatus to perform the cockling-preventing mode when the detector detects the occurrence of cockling.

3. The image forming apparatus of claim 2, wherein the detector determines the occurrence of cockling based on print-setting data set in the liquid-ejection-type image forming apparatus or transferred to the liquid-ejection-type image forming apparatus.

4. The image forming apparatus of claim 2, wherein the detector determines the occurrence of cockling based on printed image data in the liquid-ejection-type image forming apparatus.

5. The image forming apparatus of claim 2, wherein the detector judges the occurrence of cockling based on paper setting data in the liquid-ejection-type image forming apparatus.

6. The image forming apparatus of claim 2, wherein the detector judges the occurrence of cockling based on temperature and humidity data obtained at the liquid-ejection-type image forming apparatus.

7. The image forming apparatus of claim 2, wherein the image forming apparatus further comprises a monitor configured to monitor a paper condition, wherein the detector judges the occurrence of cockling based on a monitoring result of the paper condition by the monitor.

8. The image forming apparatus of claim 7, wherein the monitor is a photo sensor arranged perpendicularly or almost perpendicularly to a surface of the printing paper.

9. The image forming apparatus of claim 8, wherein the photo sensor is installed in a carriage.

10. The image forming apparatus of claim 7, wherein the monitor is a photo sensor arranged horizontally in a moving direction of the printing paper and monitoring direction.

11. The liquid-ejection-type image forming apparatus of claim 1, wherein the pair grip rollers are a pair of resist rollers.

12. The liquid-ejection-type image forming apparatus of claim 1, further comprising a gear configured to displace the printing paper temporally and to place the printing paper again on the electrostatic-absorption belt.

13. The liquid-ejection-type image forming apparatus of claim 1, wherein a voltage applied to the electrostatic-absorption belt is set large when the printing paper is place on the electrostatic-absorption belt again during the cockling-preventing mode operation.

14. The image forming apparatus of claim 1, wherein the recording head ejects the liquid droplets onto a portion of the conveyed printing paper when the portion of the printing paper is absorped on a flat portion of the electrostatic-absorption belt, the evacuation guide plate includes a flat, horizontal surface that is parallel to the flat portion of the electrostatic-absorption belt, and when the electrostatic-absorption belt conveys the printing paper in the direction opposite to the evacuation direction to the pair of grip rollers, the pair of grip rollers conveys the printing sheet onto the flat, horizontal surface of the evacuation guide plate, and then conveys the printing paper on the flat, horizontal surface of the evacuation guide plate in the direction opposite to the evacuation direction to the electrostatic-absorption belt.

15. The image forming apparatus of claim 1, wherein the evacuation guide plate further includes a vertical conveyance path to convey the sheet in a vertical direction toward the electrostatic-absorption belt, and the vertical conveyance path joins the flat, horizontal surface at an upper portion of the vertical conveyance path and at a upstream end of the flat, horizontal surface in the evacuation direction.

16. A method for preventing cockling at liquid-ejection-type image forming apparatus, comprising steps of:

performing printing operation including conveying printing paper on an electrostatic-absorption belt in a sheet conveyance direction and ejecting liquid droplets from a recording head of the liquid-ejection-type image forming apparatus onto the conveyed printing paper;

performing a cockling-preventing mode operation which stops printing operations separates the printing paper from an electrostatic-absorption belt, removes the printing paper from the electrostatic-absorption belt onto an evacuation guide plate positioned upstream of the recording head in the sheet conveyance direction, including conveying the printing paper by the electrostatic-absorption belt in an evacuation direction, opposite to the sheet conveyance direction, to a pair of grip rollers, the pair of grip rollers conveying the printing sheet in the evacuation direction onto the evacuation guide plate, and then places the printing sheet again onto the electrostatic-absorption belt, by the pair of grip rollers conveying the printing paper on the evacuation guide plate to the electrostatic-absorption belt in a direction opposite to the evacuation direction; and restarting the printing operation after the printing paper is placed again on and absorbed by the electrostatic-absorption belt.

17. The method for preventing cockling at liquid-ejection-type image forming apparatus according to claim 16, further comprising:

detecting an occurrence of cockling; and setting the liquid-ejection-type image forming apparatus in the cockling-preventing mode to cause the liquid-ejection-type image forming apparatus to perform the cockling-preventing mode when the detector detects the occurrence of cockling.

18. The method of claim 16, wherein the liquid droplets are ejected by the recording head onto a portion of the conveyed printing paper when the portion of the printing paper is absorped on a flat portion of the electrostatic-absorption belt, the pair of grip rollers conveys the printing sheet in the evacuation direction onto a flat, horizontal surface of the evacuation guide plate, the fiat, horizontal surface being parallel to the flat portion of the electrostatic-absorption belt, and and then conveys the printing paper on the flat, horizontal surface of the evacuation guide plate to the electrostatic-absorption belt.

* * * * *